US007270254B2

(12) United States Patent
Kakouras

(10) Patent No.: US 7,270,254 B2
(45) Date of Patent: Sep. 18, 2007

(54) GUN SLING

(76) Inventor: Nick Kakouras, 14894 Shannondale Rd., Purcellville, VA (US) 20132

( * ) Notice: Subject to any disclaimer, the term of this patent is extended or adjusted under 35 U.S.C. 154(b) by 582 days.

(21) Appl. No.: 10/728,390

(22) Filed: Dec. 5, 2003

(65) Prior Publication Data

US 2004/0178236 A1 Sep. 16, 2004

Related U.S. Application Data

(60) Provisional application No. 60/431,302, filed on Dec. 6, 2002.

(51) Int. Cl.
*F41C 33/02* (2006.01)

(52) U.S. Cl. ..... 224/150; 224/579; 224/913

(58) Field of Classification Search ..... 224/150, 224/257, 913, 579, 600, 627, 259, 580, 578, 224/184, 611–614, 616–618; 42/85
See application file for complete search history.

(56) References Cited

U.S. PATENT DOCUMENTS

| | | | | | |
|---|---|---|---|---|---|
| 2,715,989 | A | | 8/1955 | Sjodin et al. | |
| 3,595,451 | A | | 7/1971 | Branby | |
| 4,254,901 | A | * | 3/1981 | McIntosh | 224/258 |
| D266,180 | S | | 9/1982 | Dickinson et al. | |
| 4,463,885 | A | * | 8/1984 | Ball et al. | 224/250 |
| 4,768,689 | A | * | 9/1988 | Davis | 224/257 |
| 4,817,835 | A | | 4/1989 | Tarr, Jr. | |
| 5,282,558 | A | | 2/1994 | Martinez | |
| 5,433,360 | A | * | 7/1995 | Rock | 224/258 |
| 5,564,729 | A | * | 10/1996 | Gomez et al. | 280/637 |
| 5,615,811 | A | * | 4/1997 | Bell et al. | 224/150 |
| 5,802,756 | A | * | 9/1998 | Hightower | 42/85 |
| 5,806,742 | A | * | 9/1998 | Mott et al. | 224/645 |
| 5,810,219 | A | | 9/1998 | Rosenfield | |
| 5,881,487 | A | * | 3/1999 | Chalker | 42/85 |
| 5,915,939 | A | * | 6/1999 | French | 42/85 |
| 6,006,974 | A | * | 12/1999 | Varney et al. | 224/645 |
| 6,068,167 | A | * | 5/2000 | Hopson | 224/150 |
| 6,138,881 | A | * | 10/2000 | Paul et al. | 224/153 |
| 6,168,060 | B1 | * | 1/2001 | Mayers | 224/645 |
| 6,647,656 | B2 | * | 11/2003 | Mazzagetti | 42/85 |

* cited by examiner

*Primary Examiner*—Nathan J. Newhouse
*Assistant Examiner*—Justin M. Larson
(74) *Attorney, Agent, or Firm*—Roberts, Mardula & Wertheim, LLC

(57) ABSTRACT

A gun sling includes two straps for attaching to upper and a lower gun sling swivels on the gun to be carried. Each strap includes a padded portion at an upper end for engaging a shoulder when in use and a means for adjusting the length at the lower end of each strap. When the straps are separate, the gun can be carried and the straps can be adjusted like a backpack. Each padded portion includes one side of an attachment means to enable the padded portions of each strap to be joined together to form the embodiment of the present invention used for carrying a gun on a single shoulder. A lower Y-strap can allow the easy use of two ordinary gun slings. The gun sling allows multiple positions for carrying the gun. The dual function of the gun sling is readily apparent and intuitive to new users.

4 Claims, 2 Drawing Sheets

GUN SLING

RELATED APPLICATIONS

This application claims the benefit of U.S. Provisional Application Ser. No. 60/431,302 that was filed Dec. 6, 2002.

BACKGROUND OF THE INVENTION

The present invention is to a gun sling for rifles and shotguns that is comfortable and easy to use. The sling can be used to carry a gun in the ordinary manner, over one shoulder, or "backpack-style" over two shoulders. When carried over two shoulders, the sling of the present invention intuitively adjusts more easily for better user comfort.

Numerous prior art gun slings have been developed for comfortable use over one shoulder. U.S. Pat. No. Des. 266,180 to Dickinson et al. discloses a sling that is adjustable in length and has a padded portion for engaging a shoulder at a top end thereof. These designs usually suffer from cumbersome length adjustment when configuring the sling due to the different bulkiness of various outerwear items. Additionally, since all the weight of the gun is supported by one shoulder, users must either constantly move the gun from one shoulder to the other or suffer fatigue on one shoulder.

Numerous other prior art gun slings have been developed for comfortable use over two shoulders. U.S. Pat. No. 2,715,989 to Sjodin et al. discloses a shoulder harness for carrying a rifle over both shoulders. The unit suffers from placement of the adjustment buckles at the shoulder and a lack of padding, both of which can make the harness uncomfortable in use. Additionally, the stock-embracing strap can interfere with the gun operation and the harness is not meant to be used comfortably over a single shoulder when the gun is transported shorter distances.

U.S. Pat. No. 3,595,451 to Branby discloses a gun sling that can be used over one or both shoulders by use of a sliding member. However, because the sling must be able to pass through the sliding member, it cannot employ any padding at the shoulder position, leading to discomfort during extended use. The dual function of the sling is not readily apparent or intuitive to new users.

U.S. Pat. No. 4,817,835 to Tarr, Jr. discloses a gun sling that can be used over one or both shoulders by use of a long strap that is split longitudinally. The design of the length adjustment mechanism is non-intuitive and does not allow separate adjustment of each strap and again, this design does not employ any padding at the shoulder position, leading to discomfort during extended use.

U.S. Pat. No. 5,282,558 to Martinez. discloses a gun sling that can be used over one or both shoulders by use of a primary strap and an auxiliary strap. The design of the length adjustment mechanism does not allow quick adjustment of the primary strap and the auxiliary strap is limited to a few pre-set positions. This design positions the gun to one side of the user and does not employ any padding at the shoulder position of the auxiliary strap, leading to discomfort during extended use. The dual function of the sling is not readily apparent or intuitive to new users.

U.S. Pat. No. 5,810,219 to Rosenfeld discloses a gun sling that uses a loop attached to a rifle at two spaced-apart points to allow carrying of the rifle in a backpack position. The design of the length adjustment mechanism does not allow separate adjustment of each strap and again, this design does not employ any padding at the shoulder position, leading to discomfort during extended use. Again, the dual function of the sling is not readily apparent or intuitive to new users.

BRIEF SUMMARY OF THE INVENTION

The present invention provides a gun sling that can be used over one or both shoulders by use of a pair of padded straps. Each strap is separately adjustable by a sliding clip at a point below the padded shoulder portion for quick and easy operation by the user. The padded portion of each strap can include a fastening means to allow the padded shoulder portions of the gun sling to be attached to each other to facilitate storage and use over one shoulder.

It is an object of the present invention to provide a gun sling that can provide comfortable use for transporting a gun over either one or both shoulders.

It is another object of the present invention to provide a gun sling that is easily and quickly adjusted by a user when worn over both shoulders.

It is a further object of the present invention to provide a gun sling that can quickly adjust for use over either one or both shoulders.

It is yet another object of the present invention to provide a gun sling for use over either one or both shoulders that is inexpensive to produce.

It is another object of the present invention to provide a gun sling for use over either one or both shoulders that is intuitive for users to operate.

DETAILED DESCRIPTION OF THE INVENTION

Figure 1:
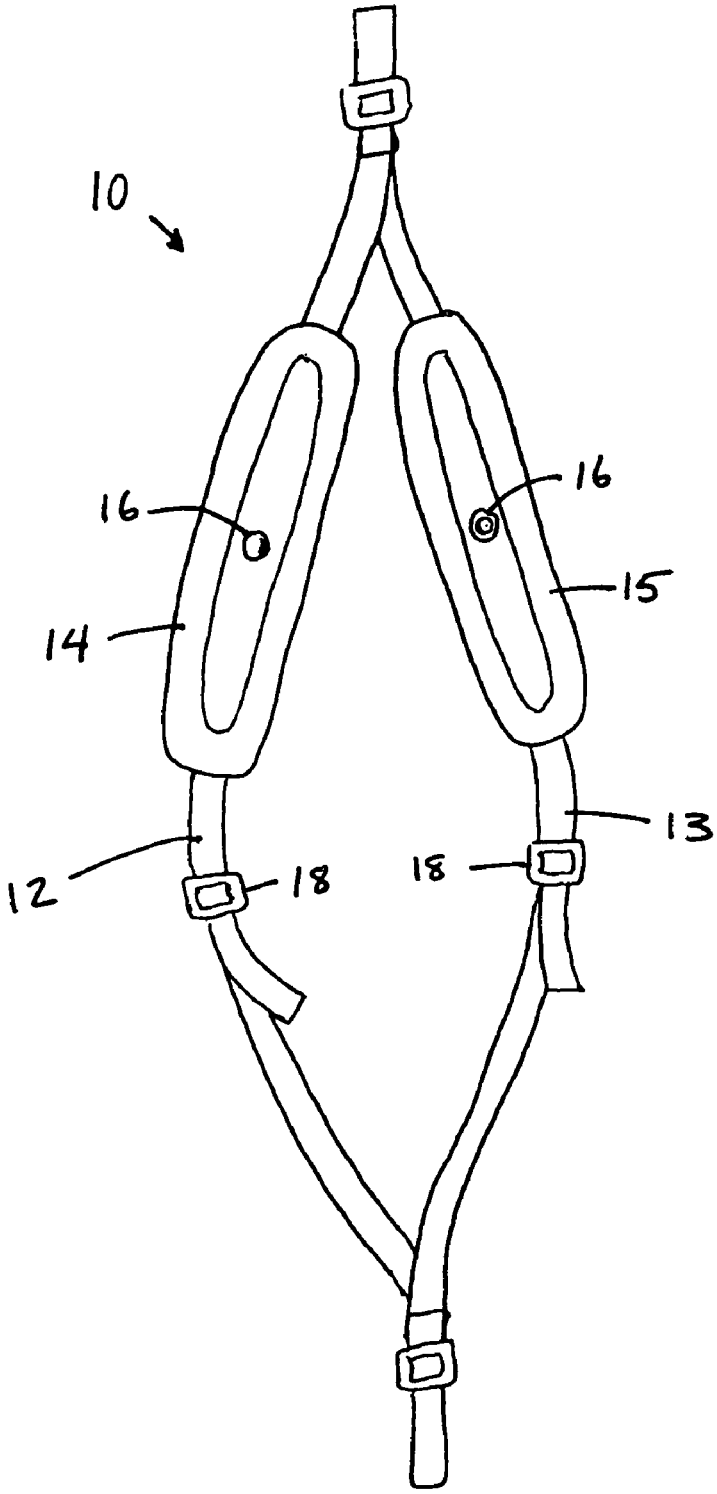
FIG. 1 illustrates an embodiment of the present invention as employed for carrying a gun backpack-style over two shoulders.

A basic embodiment of the present invention as deployed in a position for use over two shoulders is illustrated in FIG. 1. The gun sling 10 includes two straps 12, 13 for attaching, via various means, to upper and a lower gun sling swivels (not illustrated) on the gun to be carried. Each strap 12, 13 includes a padded portion 14, 15 at an upper end for engaging a shoulder when in use. Although illustrated as a separate component from the strap portion, the padded portions may be integral with the strap, sewn to the strap, attached by belt-loops, etc., such that the present invention is not meant to be limited by the illustration.

Figure 2:
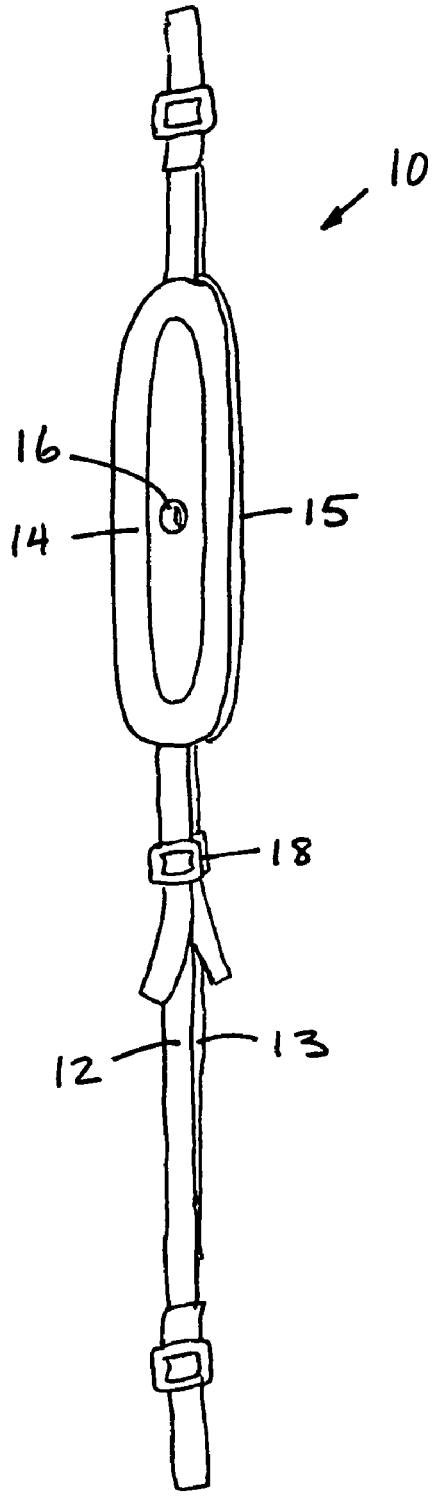
FIG. 2 illustrates an embodiment of the present invention as employed for carrying a gun in the ordinary manner over one shoulder.

In a preferred embodiment, each padded portion includes one side of an attachment means 16 to enable the padded portions 14, 15 of each strap 12, 13 to be joined together to form the embodiment of the present invention used for carrying a gun on a single shoulder, as illustrated in FIG. 2. Although illustrated as snaps on the padded portions, any suitable attachment means can be used at any appropriate point on the straps, including, but not limited to, hook-and-loop fasteners, magnetic fasteners, button-and-hole fasteners, zippers, Zip-Loc® style strips (i.e., locking plastic strips), and clasp-type fasteners. Plural attachment means may be included where deemed suitable or necessary.

Below the padded portion 14, 15 of each strap 12, 13, a sliding clip 18 is included for adjusting the length of each strap 12, 13 individually. The clips 18 are preferably positioned just below the padded portion 14, 15 for easy access by the user when worn backpack-style.

Figure 3:
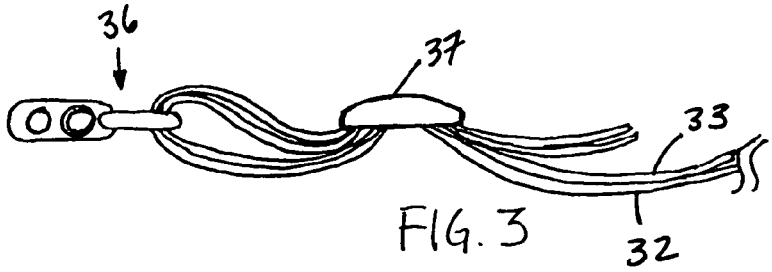
FIG. 3 illustrates one embodiment of a top attachment of the present invention to a standard gun sling swivel wherein both straps go through the swivel and clamp.
Figure 4:
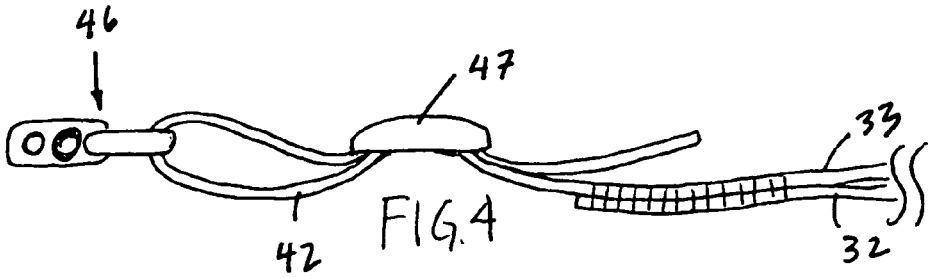
FIG. 4 illustrates another embodiment of a top attachment of the present invention to a standard gun sling swivel wherein the straps are joined together and a single strap goes through the swivel and clamp.

To minimize cost of the present invention, it may be desirable to use many "off-the-shelf" components, such as a standard single-strap padded rifle slings. Since the upper portion of the straps do not need to be separately adjustable, it may be desirable to have both straps 32, 33 of two standard slings go through the upper sling swivel 36 and a single clip or clamp 37, as illustrated in FIG. 3. Alternately, both straps 32, 33 can be joined together and a single strap 42 can then go through the upper sling swivel 46 and a single clip or clamp 47, as illustrated in FIG. 4.

Figure 5:
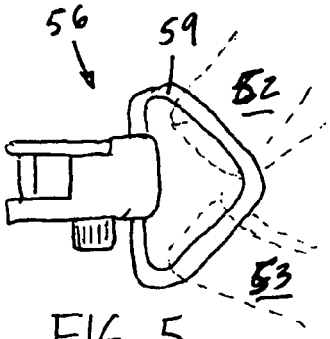
FIG. 5 illustrates a modified gun sling swivel for use with the present invention that has a triangular loop to allow attachment of two straps to a single swivel.
Figure 6:
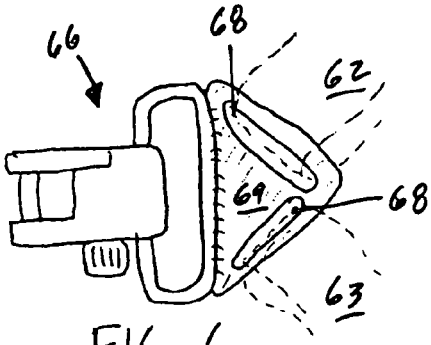
FIG. 6 illustrates a modified gun sling swivel for use with the present invention that includes a plate with two slots to allow attachment of two straps to a single swivel.

Another way that standard, single-strap, padded rifle slings can be used in the present invention is to modify the sling swivel 56 to accommodate two straps 52, 53. FIG. 5 illustrates one way to accomplish this by use of a triangular loop 59 on the sling swivel 56. FIG. 6 illustrates another manner to allow two straps 62, 63 to engage a single swivel 66 by use of two separate slots 68 in a plate 69. These modified sling swivels 66 can be used for the upper and/or lower attachment of the two straps 62, 63.

Figure 7:
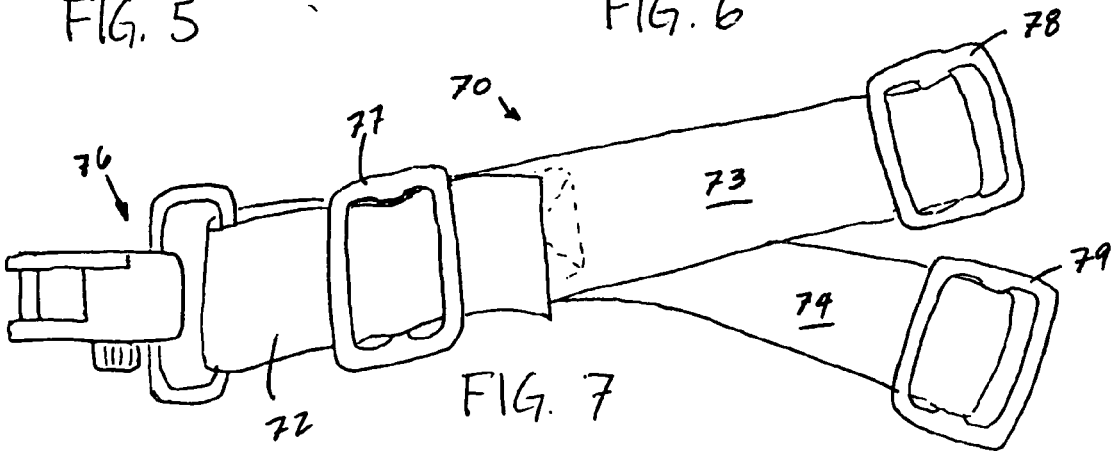
FIG. 7 illustrates a Y-strap for use with the present invention for attaching two straps to a lower gun sling swivel.

A Y-strap 70, as illustrated in FIG. 7, can be used at the lower attachment point to allow use of both standard, single-strap, padded rifle slings and a standard sling swivel 76 at the lower attachment point. The Y-strap 70 includes a single strap 72 and clip or clamp 77 at one end to engage the lower sling swivel 76 in the ordinary manner. The other end of the Y-strap includes two straps 73, 74, each terminating with a clip or clamp 78, 79 for engaging the two straps at their respective lower ends. If used, it is preferable that the two straps of the Y-strap be joined close to the lower end and that each of the two straps have equal lengths sufficient (longer than illustrated) to place their respective adjustment clip or clamp 78, 79 in a position that is easily accessed by the user when the unit is being worn backpack-style, i.e. near the bottom of the padded section, as discussed with respect to FIG. 1.

In use, the present invention will be intuitive to use since most users will already be familiar with the operation of standard, single-strap, padded rifle slings. When used in the backpack position, the unit will be adjustable in a manner identical to a backpack (i.e., adjustable straps via sliding clips or clamps just below a padded portion) such that users will intuitively loosen one side to ease removal (i.e., first side released) and attach the unit in the reverse order such that the second strap is already loose to ease slipping it over the second shoulder.

I claim:

1. A dual-position gun sling, comprising:

a first gun sling with a padded portion at an upper end;

a second gun sling with a padded portion at an upper end;

means on each of said first and second gun slings to engage an upper gun swivel;

a Y-strap for said first and second gun slings to engage a lower gun swivel, said Y-strap comprising:

a first clip for engaging a first strap at a first end to engage said lower gun swivel;

a second strap attached at a first end to a central portion of said first strap; and said first and second straps having end clips at respective second ends to engage said first and second gun slings, wherein said end clips provide a length adjustment means for said first and second gun slings, a first side of an attachment means is located on said padded portion of said first gun sling, and a second side of an attachment means is located on said padded portion of said second gun sling to selectively engage said first side of said attachment means.

2. The dual-position gun sling of claim 1, wherein said attachment means is at least one means selected from the group consisting of snaps, hook-and-loop fasteners, magnetic fasteners, button-and-hole fasteners, zippers, locking plastic strips, and clasp-type fasteners.

3. The dual-position gun sling of claim 1, wherein said means on each of said first and second gun slings to engage an upper gun swivel is selected from the group consisting of a single clip for engaging an end portion of each of said first and second gun slings, a single triangular loop at said upper swivel and clips for engaging said first and second gun slings, and a single plate with first and second slots at said upper swivel and clips for engaging said first and second gun slings.

4. A method of using a Y-strap to allow the use of two gun slings on a single gun, comprising:

engaging a first clip located at a first end of a first strap of said Y-strap to a lower swivel on said gun;

wherein a second strap is attached at a first end to a central portion of said first strap so as to form said Y-strap;

engaging end clips at respective second ends of said first and second straps to one end of said two gun slings; and engaging a second end of said two gun slings to an upper swivel on said gun.

* * * * *